United States Patent [19]

Morisaki

[11] 3,961,258

[45] June 1, 1976

[54] PULSE TIME INTERVAL MEASURING SYSTEM

[75] Inventor: Nobukazu Morisaki, Aichi, Japan

[73] Assignee: Daido Metal Company, Ltd., Nagoya, Japan

[22] Filed: Aug. 26, 1974

[21] Appl. No.: 500,740

[30] Foreign Application Priority Data

Sept. 7, 1973 Japan ..... 48-100875

[52] U.S. Cl. ..... 324/189; 324/78 E; 324/140 R; 307/294

[51] Int. Cl.[2] ..... G04F 8/00

[58] Field of Search ..... 324/78 E, 78 J, 83 A, 324/28 SE, 28 RS, 28 CH, 140, 189; 307/294; 328/127; 340/223

[56] References Cited

UNITED STATES PATENTS

| | | | |
|---|---|---|---|
| 3,163,751 | 12/1964 | Millsap et al. | 324/78 E |
| 3,393,360 | 7/1968 | Keating | 324/189 |
| 3,706,036 | 12/1972 | Marwell et al. | 324/189 |
| 3,731,195 | 5/1973 | Wessel | 324/189 |
| 3,784,803 | 1/1974 | Brendle | 307/294 |
| 3,839,673 | 10/1974 | Acker | 324/78 E |

*Primary Examiner*—R. V. Rolinec
*Assistant Examiner*—Michael J. Tokar
*Attorney, Agent, or Firm*—Karl W. Flocks

[57] ABSTRACT

A pulse time interval measuring system in which a desired input signal is selected from among a plurality of input signals each consisting of a plurality of pulse signals, and the time interval between predetermined pulse signals in the desired input signal is measured by a CR time constant circuit to give a digital display of such time interval.

3 Claims, 4 Drawing Figures

PULSE TIME INTERVAL MEASURING SYSTEM

This invention relates to a pulse time interval measuring system which receives selectively a plurality of input signals each including a plurality of pulse signals and gives a display of the time interval between the pulse signals.

In production processes in which, for example, various parts are worked in various ways to produce products, measurement of the operating period of time of a production line or machine tools, or more specifically, measurement of the period of time required for the production line or machine tools to manufacture each individual product is necessary for establishing standard cycles classified by the sort of the products, computing the production time schedule and grasping the faculty of production control. To this end, means capable of measuring microscopically such as a stop watch has been used hitherto for the measurement of the operating period of time of individual machine tools. This method has however been defective in that the proper rate of operation of each individual machine tool cannot be easily established.

It is therefore a primary object of the present invention to provide an inexpensive and precise pulse time interval measuring system of simple structure which is not only suitable for production process control but also applicable to various other fields.

In accordance with the present invention, there is provided a pulse time interval measuring system comprising input signal switching means for switching over a plurality of input signals each including a plurality of pulse signals thereby selecting any desired one of said input signals, step switching means for switching over a plurality of steps in response to the application of the pulse signals included in the selected input signal, a CR time constant circuit controlled in the charging operation thereof by the output of said step switching means, and time display means for measuring the value of the charged voltage in said CR time constant circuit to give a digital display of the time corresponding to the charged voltage, the displaying operation of said time display means being controlled by said step switching means.

In the application of the pulse time interval measuring system of the present invention to the production process control above described, detectors such as microswitches or photoelectric relays are provided to detect the operation of individual machine tools and are connected at the outputs thereof to the respective inputs of the input signal switching means. The input signal switching means is then switched over to a position in which the operating period of time of any desired one of the machine tools is measured. A pulse signal is generated from the associated detector in each operating cycle of the machine tool to switch over the step switching means. When a predetermined step is reached, a capacitor in the CR time constant circuit in the next stage is charged. The charging of the capacitor is ceased when this predetermined step is changed over to the next step. As is commonly known, a capacitor has such a charging characteristic that voltage charged therein increases in a linearly proportional relation with respect to time up to a certain point. This linearly increasing range of voltage in simple proportion to time can be utilized to easily seek the lapse of time corresponding to the charged voltage value. Therefore, the time is displayed when this charged voltage is measured, and this time represents the period of time required for one working process.

By the application of the pulse time interval measuring system of the present invention to the production process control, the working hours of one day, the number of products produced in one day, the production pitch, etc. can be automatically microscopically measured so that a reasonable operation rate of the machine tools can be easily sought. Further, a standard cycle can be easily computed, and therefore, a reasonable working period of time can be easily established on the basis of a deviation from the standard cycle thus computed. Further, a process or processes which will provide a neck against efficient production can be detected by measuring the operating period of time of individual machine tools, and it is thus possible to make necessary improvements in the machine tools etc.

The above and other objects, features and advantages of the present invention will be apparent from the following detailed description of a preferred embodiment thereof taken in conjunction with the accompanying drawing, in which.

Figures 1, 2:
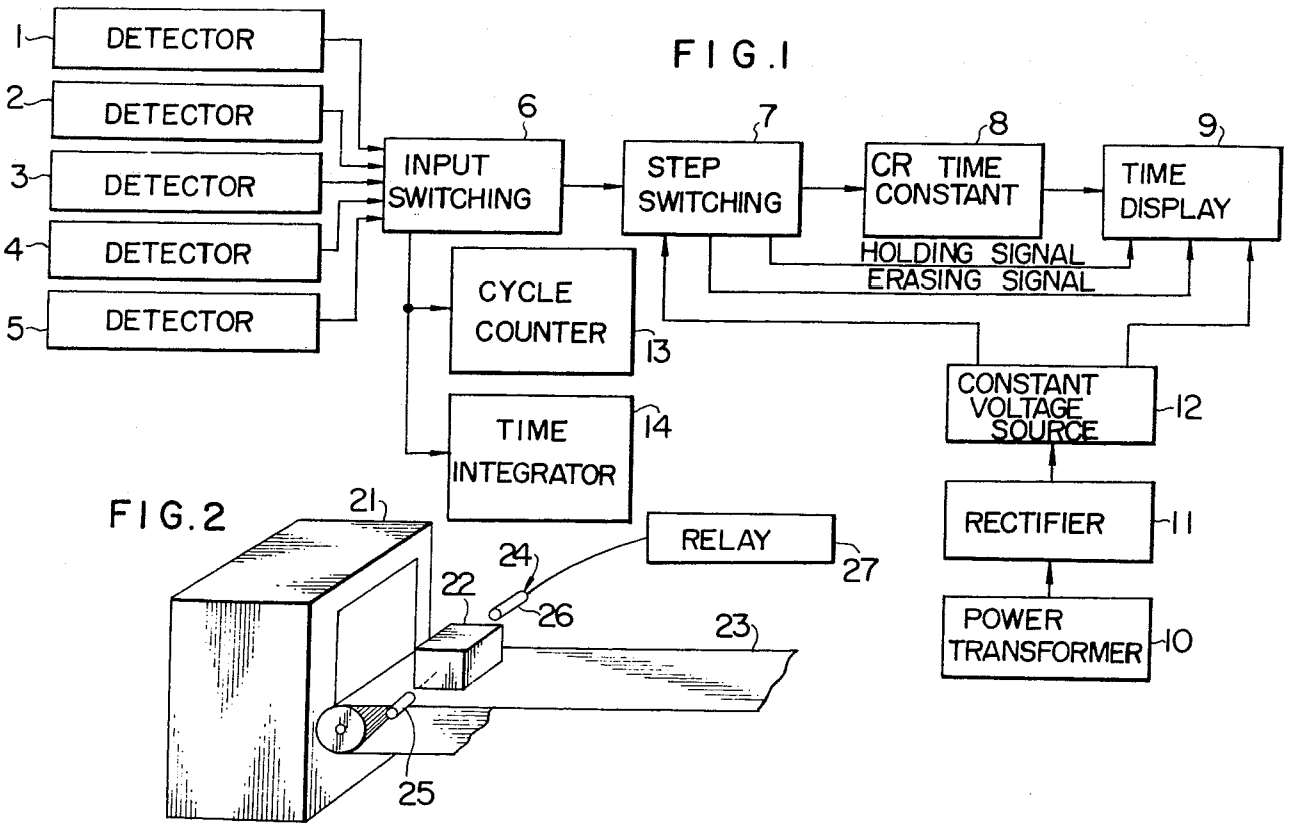
FIG. 1 is a block diagram of an embodiment of the present invention.
FIG. 2 is a schematic view of one form of detecting means used in the present invention.

Referring to FIG. 1, an embodiment of the system according to the present invention is shown applied to control of five processes. Five detecting units 1 to 5 are mounted on respective machine tools arranged for individual processes to detect the operation of these tools and generate a pulse signal in response to one cycle of the operation of the tools. These detecting units 1 to 5 may be microswitches, proximity relay units or photoelectric relay units. The signals from the detecting units 1 to 5 are applied to an input signal switching unit 6. This input signal switching unit 6 selects any desired one of the input signals applied from the detecting units 1 to 5 and may be manual change-over switch means. The signal from the desired detecting unit thus selected by the input signal switching unit 6 is applied to a step switching unit 7. The step switching unit 7 acts to automatically and sequentially change over the steps in response to the arrival of signal inputs and is constructed to operate according to a predetermined program so that a capacitor in a CR time constant circuit 8 in the next stage can start to be charged at a predetermined step and then discharge at another predetermined step. Further, this step switching unit 7 acts to control the transmission of control signals used for displaying time and erasing the time displayed on a time display unit 9. Charging of the capacitor in the CR time constant circuit 8 starts when a predetermined step is reached in the step switching unit 7 and such charging ceases when this predetermined step is changed over to another predetermined step as above described, and the voltage charged therein up to that time is applied to the time display unit 9.

The time display unit 9 is actually a digital voltmeter which measures the voltage charged in the capacitor in the CR time constant circuit 8. More precisely, due to the fact that the voltage charged in the capacitor in the CR time constant circuit 8 within the linear range of the charging characteristic of the capacitor has a certain proportional relation with the charging period of time, such relationship is utilized so as to make a digital display of time corresponding to the value of charged voltage.

Power supplied from a commercial power source is transformed into a suitable voltage by a power transformer 10, and such voltage is rectified by a rectifier circuit 11 and is then applied to a constant voltage power supply circuit 12. A constant voltage supplied from this constant voltage power supply circuit 12 is used to drive the step switching unit 7 and time display unit 9.

A known cycle counter 13 and a known time integrator 14 are connected to the input signal switching unit 6. The cycle counter 13 counts the number of operating cycles of the machine tools to measure the number of worked products utilizing the fact that a pulse signal is applied to the input signal switching unit 6 from one of the detecting units 1 to 5 in each operating cycle of the associated machine tool. The time integrator 14 displays a total of the operating periods of time in response to an instruction signal applied from the step switching unit 7.

The step change-over occurs in the step switching unit 7 in response to the operation of the detecting units 1 to 5, that is, in response to the appearance of the pulse signal in each operating cycle of the machine tools. Therefore, the period of time ranging from the appearing time of one pulse signal to the appearing time of the next pulse signal corresponds to the period of time required for working on one product. Thus, the period of time required for working on one product in one process can be displayed by applying the voltage to the capacitor in the CR time constant circuit 8 to charge the capacitor for that period of time, measuring the value of the voltage charged in the capacitor and displaying the time corresponding to the measured value.

FIG. 2 shows one form of the detecting units 1 to 5. FIG. 2 illustrates the case in which a workpiece 22 machined by a machine tool 21 such as a lathe is transferred to another machine tool such as another lathe or grinding machine (not shown) by a belt conveyor 23, and a photoelectric relay means 24 is provided adjacent to the belt conveyor 23. Referring to FIG. 2, a light source 25 and a light receiving element 26 are disposed on opposite sides of the belt conveyor 23 at the delivery side of the machine tool 21 in such a manner that the light from the light source 25 is intercepted by the workpiece 22 being conveyed by the belt conveyor 23, and a relay 27 which is energized by detecting the interception of light by the workpiece 22 produces a pulse signal each time such workpiece 22 passes between the light source 25 and the light receiving element 26 to detect the operation of the machine tool 21. A proximity relay means may be employed in place of the photoelectric relay means. When each machine tool has a shaft which makes one complete rotation during one cycle, for example, one cycle consisting of mounting, chucking, cutting and delivery of a workpiece, a cam may be mounted on this shaft to actuate a contact type switch such as a microswitch thereby producing a pulse signal for directly detecting the operation of the machine tool.

Figure 3:
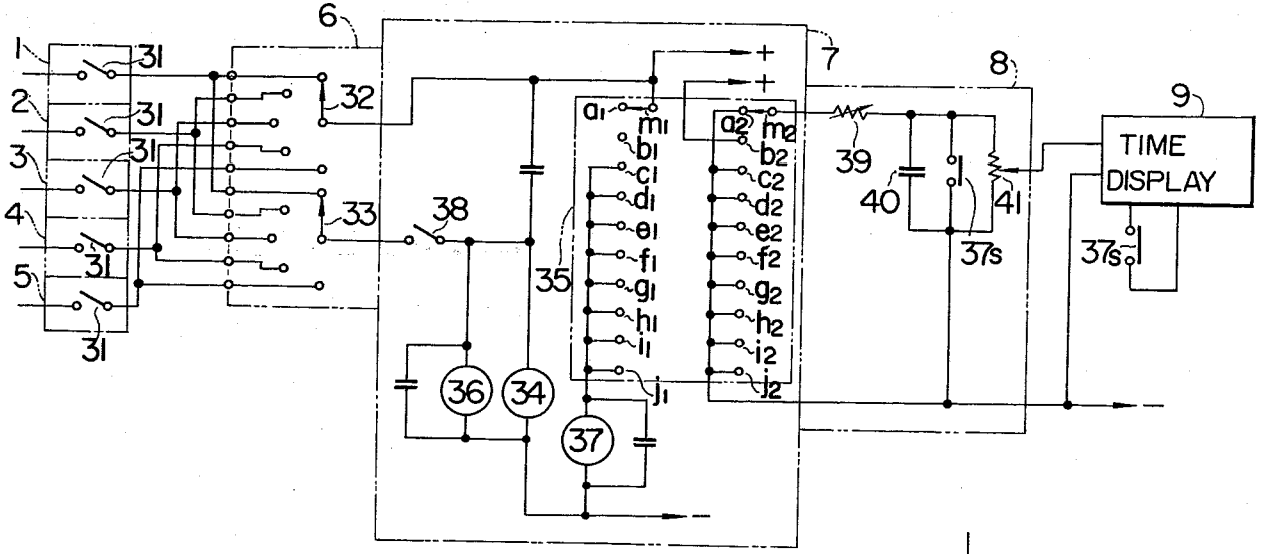
FIG. 3 shows details of input signal switching means, step switching means, a CR time constant circuit and time display means in the present invention and shows also electrical connections therebetween.

FIG. 3 shows the details of the structure of and electrical connections between the detecting units 1 to 5, input signal switching unit 6, step switching unit 7, CR time constant circuit 8 and time display unit 9. The detecting units 1 to 5 mounted on the individual machine tools arranged for the five respective processes are in the form of switches 31 which are closed in response to the operation of the associated tools to apply pulse signals to the input signal switching unit 6. This input signal switching unit 6 comprises two manual switches 32 and 33 arranged for interlocking operation, and these manual switches 32 and 33 are manually selectively changed over for the measurement of the desired processes.

The step switching unit 7 comprises an electromagnetically operated rotary switch consisting of an electromagnet 34 energized by the signal applied from the detecting units 1 to 5 and a contact assembly 35 consisting of contacts sequentially changed over in response to the energization of this electromagnet 34. The step switching unit 7 comprises further a counter drive relay 36 for driving the cycle counter 13, an instruction relay 37 for instructing the display of time and erasing of the time displayed on the time display unit 9, and a switch 38 for turning on and off the operation of the step switching unit 7. The contact assembly 35 in the electromagnetically operated rotary switch comprises a first contact mechanism consisting of a movable contact *m*1 brought sequentially into contact with ten stationary contacts *a*1 to *j*1 in response to the sequential energization of the electromagnet 34, and a second contact mechanism consisting of a movable contact *m*2 brought sequentially into contact with ten stationary contacts *a*2 to *j*2. This second contact mechanism is arranged for interlocking operation with the first contact mechanism. The stationary contacts *c*1 to *j*1 in the first contact mechanism except the stationary contacts *a*1 and *b*1 are connected to the instruction relay 37. All the stationary contacts in the second contact mechanism except the stationary contact *b*2 are grounded, and the stationary contact *b*2 is connected to the positive side of the power supply. The movable contact *m*1 is connected to the positive side of the power supply, while the movable contact *m*2 is connected to a variable resistor 39 in the CR time constant circuit 8.

Therefore, when the pulse signal from the desired detecting unit is applied through the input signal switching unit 6 to the step switching unit 7 due to the operation of the associated machine tool, the electromagnet 34 is energized when such pulse signal is applied, and the movable contacts *m*1 and *m*2 are brought into contact with the respective stationary contacts *b*1 and *b*2 from the previous positions in which they are in contact with the respective stationary contacts *a*1 and *a*2. Due to the fact that the movable contacts *m*1 and *m*2 are now brought into contact with the respective stationary contacts *b*1 and *b*2 in response to the application of the first pulse signal, the positive power supply voltage is applied to the CR time constant circuit 8 through the contacts *m*2 and *b*2. Then, when the movable contacts *m*1 and *m*2 are brought into contact with the respective stationary contacts *c*1 and *c*2 due to the application of the next or second pulse signal, the instruction relay 37 is energized to cease the application of the voltage to the CR time constant circuit 8.

The CR time constant circuit 8 comprises a variable resistor 39 and a capacitor 40 determining the time constant, a variable resistor 41 for adjusting the output level, and a make contact 37*s* of the instruction relay 37. The capacitor 40 is charged with the positive power supply voltage when the movable contact *m*2 is brought into contact with the stationary contact *b*2 in the step switching unit 7.

The voltage charged in the capacitor 40 is measured by the time display unit 9 which is a digital voltmeter, and the time corresponding to the charged voltage is displayed on the time display unit 9. When, for example, a digital voltmeter whose full scale is 9.99 mv is employed, the variable resistor 39 is set to give a time constant previously sought by calculation, and then while manipulating the variable resistor 41 and using means such as a stop watch for calibration, the capacitor 40 is charged in such a manner that the voltage charged therein attains a level of 9.99 mv within 9.99 seconds. By setting the time constant in the manner above described, the digital voltmeter can be utilized as a digital time display means.

The capacitor 40 discharges when the state of the step switching unit 7 is changed over to the next step, that is, when the movable contacts *m*1 and *m*2 are brought into contact with the respective stationary contacts *c*1 and *c*2. At this time, the instruction relay 37 is energized and its make contact 37*s* is closed so that the capacitor 40 discharges through this make contact 37*s*. Since the digital voltmeter per se is well known in the art, any detailed description and illustration of the structure thereof is unnecessary. The time display unit 9 holds its display due to the fact that the instruction relay 37 is in the energized state. Generally, this digital voltmeter is provided with a display holding terminal. However, when such a display holding terminal is not provided, it is necessary to connect a resistor having a high resistance to the movable arm of the variable resistor 41 in order to prevent leakage of the charged voltage. The instruction relay 37 is kept in the energized state until the movable contacts *m*1 and *m*2 are brought into contact with the respective stationary contacts *a*1 and *a*2 again as a result of the sequential arrival of the pulse signals to the step switching unit 7 from the detecting units 1 to 5. Thus, the time displayed on the time display unit 9 is held until the instruction relay 37 is deenergized. In the present invention, a rotary switch having ten stationary contacts is employed. Therefore, the time displayed on the time display unit 9 is erased after ten pulse signals have been applied from the detecting units 1 to 5.

Figure 4:
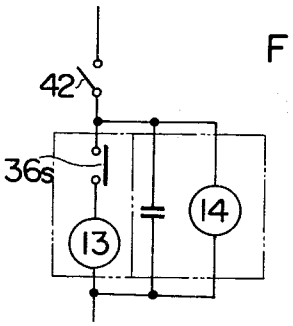
FIG. 4 is an electrical connection diagram of a cycle counter and a time integrator.

FIG. 4 shows an electrical connection between the cycle counter 13 and the time integrator 14. The cycle counter 13 and the time integrator 14 are connected through a power supply switch 42. The number of operating cycles of the machine tools represents the number of products subjected to working, and therefore, the counter 13 is connected through a make contact 36*s* of the counter drive relay 36 in the step switching unit 7. Both the cycle counter 13 and the time integrator 14 are well known in the art and any detailed description and illustration of the structure thereof is unnecessary.

It will be understood from the foregoing description that five processes can be set according to the present embodiment, and one out of ten products can be picked up in the course of working in these processes to measure and display the period of time required for working of one pitch. Further, by changing over the input signal switching unit 6, the period of time required for working on a product in one process, for example, the period of time required for mounting → chucking → cutting → delivery of a product can be displayed on the time display unit 9. Therefore, the period of time required in each process can be known when such period of time is previously adjusted. It is thus possible to make improvements in the process which provides the greatest neck in respect of time in the production line thereby shortening the working period of time in that process.

In the embodiment above described, the input signal switching unit 6 and step switching unit 7 are illustrated as having five and ten change-over stages respectively by way of example. However, it is apparent to those skilled in the art that the number of such stages can be easily varied.

In the embodiment above described, the variable resistor 39 of 500 kΩ and the capacitor 40 of 500 μF were employed to display time ranging from 0 to 10 seconds. The precision was better than 1% (0.8% in actual measurement) and the resolution was 1/100 second.

It will be appreciated that the present invention provides an inexpensive digital time counter which is simple in construction, operates with high precision and can be easily handled in spite of a simple combination of a digital voltmeter and a CR time constant circuit.

What is claimed is:

1. A pulse time interval measuring system comprising a plurality of signal generating means each generating a pulse train signal, selecting means connectable to any desired one of said signal generating means, step switching means connected to said selecting means and having a first and a second contact mechanism arranged to be changed over stepwise in interlocking relation in response to the output of said selecting means, a CR time constant circuit having a capacitor and a resistor, said CR time constant circuit so connected to said first contact mechanism that said capacitor is charged only when a predetermined contact is connected to said RC time constant circuit, while said capacitor discharges when the remaining contacts are connected thereto, and time display means for measuring the value of the charged voltage in said capacitor to give a digital display of the time corresponding to the charged voltage.

2. A pulse time interval measuring system comprising input signal switching means for switching over a plurality of input signals each including a plurality of pulse signals, thereby selecting any desired one of said input signals, step switching means connected to said input signal switching means for switching over a plurality of steps in response to the application of the pulse signals included in the selected input signal, a CR time constant circuit controlled in the charging operation thereof by the output of said step switching means, and time display means for measuring the value of the charged voltage in said CR time constant circuit to give a digital display of the time corresponding to the charged voltage, the displaying operation of said time display means being controlled by said step switching means, said step switching means including a first and a second contact mechanism arranged to be changed over stepwise in interlocking relation in response to the application of said pulse signals, said first contact mechanism controlling the charge and discharge of said CR time constant circuit, and said second contact mechanism controlling the operation of said time display means, said first contact mechanism operating in such a manner that a capacitor in said CR time constant circuit is charged only when a predetermined contact is connected thereto, while said capacitor discharges when the remaining contacts are connected thereto, said second contact mechanism being connected to an instruction relay which instructs displaying of time and erasing of the display on said time display means, and said instruction relay is deenergized for erasing the display on said time display means when said first contact mechanism is changed over to the position in which said capacitor is charged.

3. A pulse time interval measuring system as claimed in claim 2, wherein said CR time constant circuit comprises a make contact of said instruction relay connected in parallel with said capacitor so that the discharge voltage may not be applied to said time display means during the period of time in which said instruction relay is in the energized state.

* * * * *